US007448324B1

(12) United States Patent
King et al.

(10) Patent No.: US 7,448,324 B1
(45) Date of Patent: Nov. 11, 2008

(54) SEGMENTED ROD PROJECTILE

(75) Inventors: Hartley Hughes King, Santa Barbara, CA (US); Thomas Louis Menna, Santa Barbara, CA (US); Lawrence Steven Romero, Santa Ynez, CA (US)

(73) Assignee: AT&T Intellectual Property II, L.P., Reno, NV (US)

( * ) Notice: Subject to any disclaimer, the term of this patent is extended or adjusted under 35 U.S.C. 154(b) by 51 days.

(21) Appl. No.: 11/501,540

(22) Filed: Aug. 9, 2006

Related U.S. Application Data

(60) Provisional application No. 60/797,205, filed on May 3, 2006.

(51) Int. Cl.
*F42B 12/58* (2006.01)

(52) U.S. Cl. ..... 102/517; 102/393; 102/489

(58) Field of Classification Search ..... 102/439, 102/703, 517, 506, 393, 438, 489
See application file for complete search history.

(56) References Cited

U.S. PATENT DOCUMENTS

| | | | | | |
|---|---|---|---|---|---|
| 2,897,757 | A * | 8/1959 | Kulluck | ..... | 102/438 |
| 3,500,714 | A * | 3/1970 | Cullinane | ..... | 89/1.1 |
| 3,818,833 | A * | 6/1974 | Throner, Jr. | ..... | 102/389 |
| 4,090,446 | A | 5/1978 | Tomasetti | | |
| 4,372,216 | A * | 2/1983 | Pinson et al. | ..... | 102/489 |
| 4,488,489 | A * | 12/1984 | Schoffl | ..... | 102/489 |
| 4,676,167 | A * | 6/1987 | Huber, Jr. et al. | ..... | 102/393 |
| 4,854,241 | A * | 8/1989 | Synofzik et al. | ..... | 102/489 |
| 4,856,432 | A * | 8/1989 | Synofzik | ..... | 102/489 |
| 4,901,645 | A * | 2/1990 | Bisping et al. | ..... | 102/521 |
| 5,088,416 | A * | 2/1992 | Sabranski | ..... | 102/517 |
| 5,237,925 | A * | 8/1993 | Vogt et al. | ..... | 102/386 |
| 552,652 | A | 6/1996 | Dahl et al. | | |
| 5,834,684 | A * | 11/1998 | Taylor | ..... | 102/517 |
| 5,988,071 | A * | 11/1999 | Taylor | ..... | 102/473 |
| 6,021,716 | A * | 2/2000 | Taylor | ..... | 102/517 |
| 6,510,797 | B1 | 1/2003 | Fong | | |
| 6,666,145 | B1 * | 12/2003 | Nardone et al. | ..... | 102/489 |
| 6,817,568 | B2 * | 11/2004 | Spate et al. | ..... | 244/3.15 |
| 6,834,593 | B2 * | 12/2004 | Nardone et al. | ..... | 102/489 |
| 7,017,495 | B2 * | 3/2006 | Sexton | ..... | 102/439 |
| 2004/0107861 | A1 * | 6/2004 | Nardone et al. | ..... | 102/489 |
| 2004/0231550 | A1 * | 11/2004 | Sexton | ..... | 102/501 |
| 2006/0162603 | A1 * | 7/2006 | Sexton | ..... | 102/439 |

* cited by examiner

*Primary Examiner*—James S Bergin
*Assistant Examiner*—Daniel J Troy
(74) *Attorney, Agent, or Firm*—Ronald D. Slusky

(57) ABSTRACT

At least some of the segments of a segmented rod projectile are provided with a mechanism that causes them to divert away from the projectile's original line of flight after the segments are separated during flight to the target. That mechanism is illustratively a notched flare. The segments illustratively divert in a predetermined dispersion pattern. In order to ensure that each segment flies in the desired direction after separation, the disclosed projectile includes a mechanism that, just prior to segment separation, arrests spin of the projectile. Thus the segments are essentially non-spinning after separation and thus the desired diversion will not be counteracted by post-separation spin of the segments.

14 Claims, 9 Drawing Sheets

SEGMENTED ROD PROJECTILE

CROSS-REFERENCE TO RELATED APPLICATION

This application claims the benefit of U.S. provisional application 60/797,205 filed May 3, 2006.

BACKGROUND OF THE INVENTION

The present invention relates to munitions.

A known type of munitions projectile is a so-called segmented rod projectile, or penetrator. As the name implies, such a projectile is in the form of a rod that is made up of interconnected segments. The projectile is launched toward a target from a medium-to-large caliber gun, a missile, or even just gravity-dropped from high altitude, for example. At a particular point in the projectile's flight toward the target, the segments are separated from one another by an appropriate separation mechanism. The target is thus impacted by the separate but collinear segments, rather than being impacted by a unitary projectile. This is advantageous because of the segment aspect ratio effect that results in added penetration efficiency of the multiple impacting segments. This will typically produce greater penetration than would a unitary projectile of the same total mass and length. For this type of projectile to be effective the impact velocity, segment spacing and segment alignment are important design factors.

SUMMARY OF THE INVENTION

The present invention is directed to an improved segmented rod projectile. In accordance with the invention, the projectile is designed in such a way that at least some of the segments are made to divert away from the original line of flight after being separated from one another. The target is thus impacted over a wider area than with prior art segmented rod projectiles whose segments continue to fly substantially collinearly after separation. This, advantageously, enables the weapon to more effectively damage and/or destroy particular types of targets over a wider range of velocities without the limitations of segment alignment and spacing mentioned previously Diversion of the segments is illustratively effectuated through aerodynamic design of the segments. The aerodynamic design of the segments illustratively features a notched flare that causes the segment diversion.

The segments illustratively divert in a predetermined dispersion pattern, which is radially symmetric in the disclosed embodiment, but need not be. Indeed, appropriate design of the projectile can result in various symmetric or non-symmetric dispersion patterns as may be desired for a given application. In order to ensure that each segment flies in the desired direction after separation, the projectile may advantageously include a mechanism that, just prior to segment separation, arrests spin of the projectile. Thus the segments are essentially non-spinning after separation and thus the desired diversion will not be counteracted by post-separation spin of the segments.

A wide dispersion pattern such as achieved by the present invention is achieved by some prior art projectile designs such as those having warheads that are explosively fragmented in flight or that release individual small non-aerodynamically shaped fragments similar to the way in which the "shot" of shotgun shells or a hand grenade is sprayed over a target area. A projectile embodying the principles of the present invention, however, can provide several advantages over those approaches. These include increased control over the flight performance of the segments, thereby achieving increased target-impacting effectiveness and lower collateral damage, and reduction in time of flight-to-target due to a lower drag configuration.

A segmented rod penetrator of the same general type as the present invention is disclosed in U.S. Pat. No. 5,834,684 issued Nov. 10, 1998 to Robert J. Taylor. The '684 patent notes that if the segments are separated at a suitably large distance from the intended target, then asymmetric aerodynamic forces acting upon the segments after separation can cause the segments to scatter so that the penetrator segments impact the target in multiple locations. Such multiple-location impact is the same general functionality provided by the present invention.

In stark contrast to the present invention, however, no explicit design mechanism, such as the aforementioned notched flares of the disclosed embodiment, is incorporated into the segments of the penetrator disclosed in the '684 patent so as to cause them to divert from the original trajectory. Rather, the arrangement disclosed in the '684 patent seems to rely on such random mechanisms as uncontrolled and non-uniform petal deployment between segments during separation in the aerodynamic flow field to cause the diversion. Since that approach requires that the segments be separated relatively early in the flight, it suffers from the same disadvantages as explosive-fragmenting projectiles. Thus the present invention provides the same advantages over the approach disclosed in the '684 patent as mentioned above in connection with the explosively-fragmented projectiles. Indeed, the disadvantages of the approach disclosed in the '684 patent may be even more pronounced than for the previously-mentioned approaches because aerodynamic separation requires that the segments be separated quite early in the flight, adversely affecting co-linearity at impact. Moreover, that design is such that the segment velocity is significantly decreased. Moreover, reliance on random diversion of the flight of the segments means that the shape and breadth of the dispersion pattern will not be controlled or reproducible—at least not to the same extent as is achieved by use of the present invention.

DETAILED DESCRIPTION OF AN ILLUSTRATIVE EMBODIMENT

Figure 1:
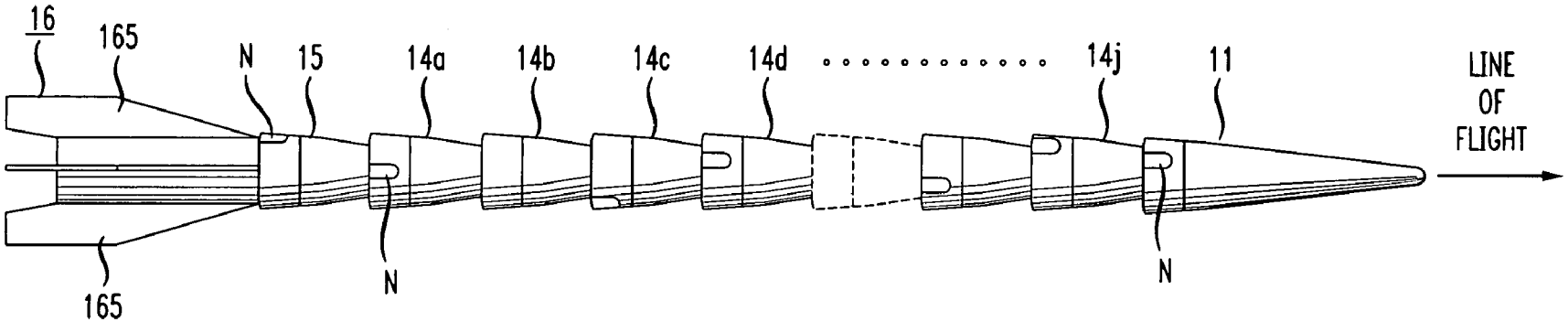
FIG. 1 shows a segmented projectile embodying the principles of the present invention.

FIG. 1 shows a segmented projectile or penetrator 10 (hereinafter "projectile") embodying the principles of the present invention.

Projectile 10 includes a lead segment 11, a number of intermediate segments 14*a*-14*j* and 15, and a tail segment 16. Segment 15 is also referred to herein as the "second-to-last" segment. The main body of each of the segments is illustratively made from a tungsten alloy to maximize penetration but could effectively be made of other materials depending on the application and launcher characteristics and constraints. Projectile 10 can be of various sizes, from a fraction of a foot to tens of feet, depending on the application.

Segments 14*a*-14*j* and 15 are of a generally conical shape. The body of tail segment 16 is of a generally cylindrical shape and has a number of fins 165 attached thereto. Illustratively, there are four fins 165, but six fins is also typical in projectiles of this type and projectile 10 could certainly have six fins or any other desired number. Overall, projectile 10 has a high ballistic coefficient (mass-to-drag-area ratio) in order to get it to its target with a high impact velocity.

Each of the segments except for tail segment 16 terminates in a notched flare having a notch N described more fully below.

Projectile 10 is designed to be launched from a gun or other launch platform in the low-drag configuration shown, i.e., as a mono rod or unsegmented single continuous rod. Indeed, if desired, it could be allowed to fly all the way to its target in that form. However, projectile 10 is designed to break into multiple individual segments just before impact, with the segments then continuing on to the target. Projectile 10 is illustratively a kinetic energy projectile, meaning that the target is damaged and/or destroyed simply by virtue of the kinetic impact energy of the segments, rather than by chemical energy from any explosive charged warhead.

The separation of the segments—referred to herein as "segmentation"—is brought about in any desired way using, for example, compressed springs, explosive charges or aerodynamically with the deployment of petals on the segments. The manner in which the segmentation is brought about is not germane to the invention and thus need not be described in further detail herein.

In accordance with the invention, the projectile is designed in such a way that at least some of the segments are made to divert away from the original line of flight of the projectile after being detached, or separated, from the rest of the projectile. The target is thus impacted over a wider area than with prior art segmented rod projectiles whose segments continue to fly substantially collinearly after separation. This, advantageously, enables the projectile to more effectively damage and/or destroy particular types of targets.

Figure 2:
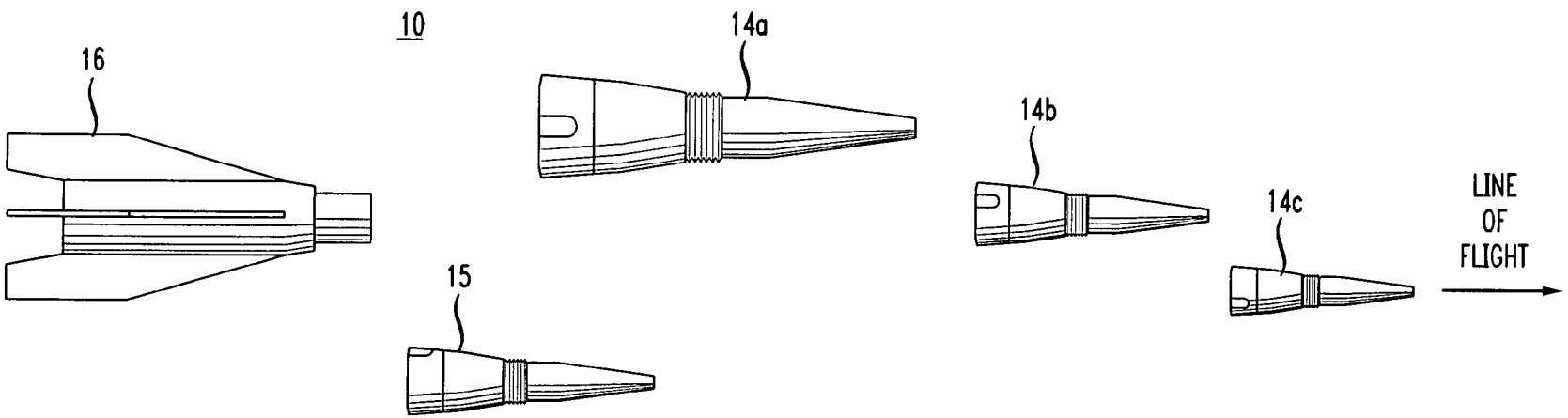
FIG. 2 shows the rear five segments of the projectile of FIG. 1 in flight at a point in time after segmentation.
Figure 3:
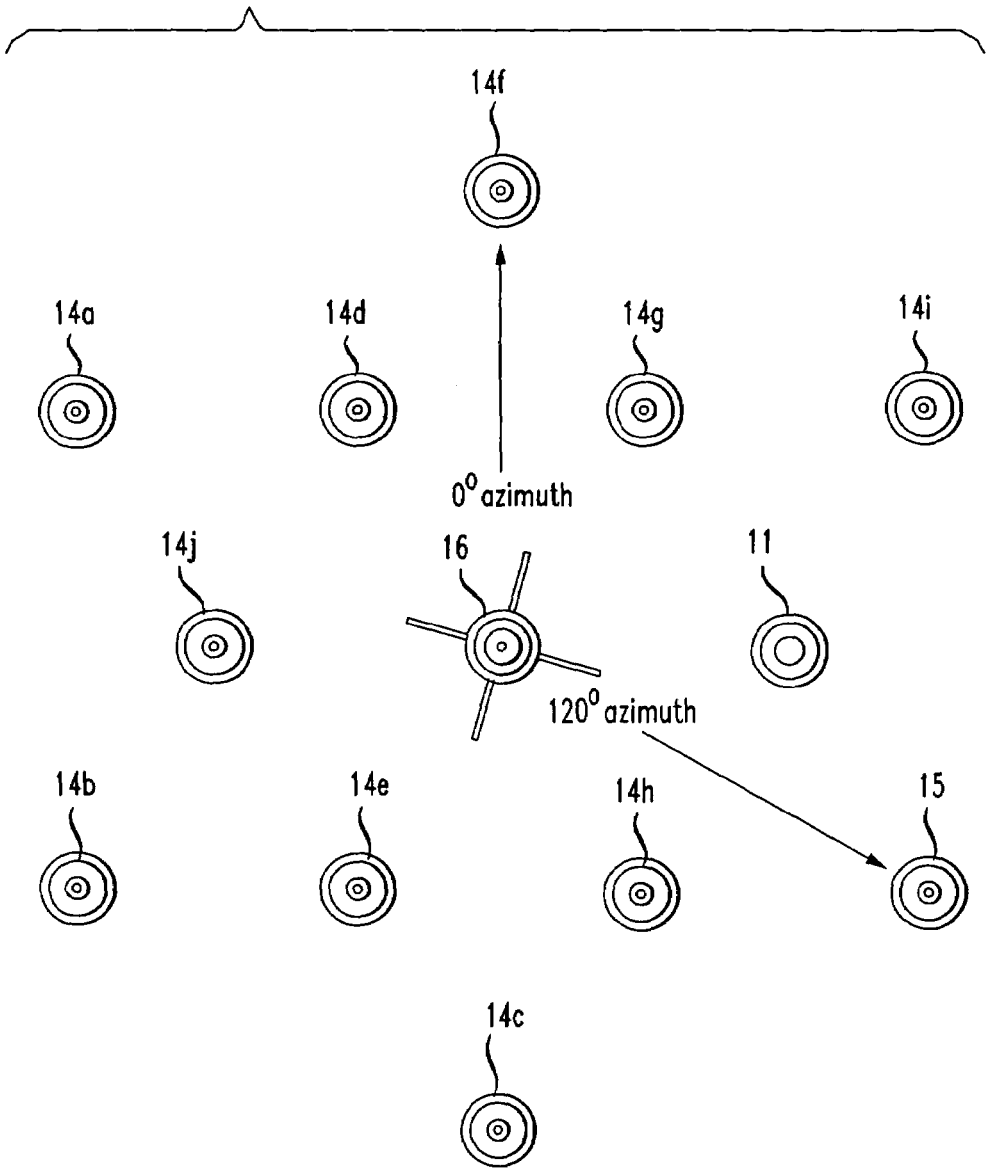
FIG. 3 is a head-on view of the dispersion pattern of the segments after the projectile has fully segmented.

This is seen in FIG. 2, depicting the five aftmost segments after segmentation has occurred. The diversion of any given segment can be in any azimuthal direction radially away from the line of flight, resulting in any desired dispersion pattern, and depends on the pre-selected azimuth of notch N position on the projectile set during the final projectile assembly process. The magnitude of radial motion of each segment is selectable by the size (area) of its notch N. One such pattern is shown in FIG. 3. Tail segment 16 has continued on the original line of flight and the other segments have dispersed into the pattern shown. Segment 15, for example, has diverted in approximately the 120-degree azimuthal direction relative to the line of flight flown. Segments 14*a*, 14*b* and 14*c* have diverted in approximately the 300-, 240- and 180-degree azimuthal directions, respectively. In FIG. 2 certain of the segments are depicted larger or smaller than in FIG. 1 (albeit in an exaggerated fashion) to depict the fact that segment 14*a* has diverted out of the plane of the figure; that segments 15 and 14*b* have diverted into the plane of the figure; and that segment 14*c* has diverted even further into the plane of the figure. Although not shown in FIG. 2, the other segments of the projectile will also at this time be flying separately, each in its predetermined azimuthal direction, per FIG. 3. Illustratively, the azimuthal pattern is symmetric, but this is not required. Indeed, a wide variety of symmetric or non-symmetric dispersion patterns can be realized, as may be desired for a given application.

Figure 4:
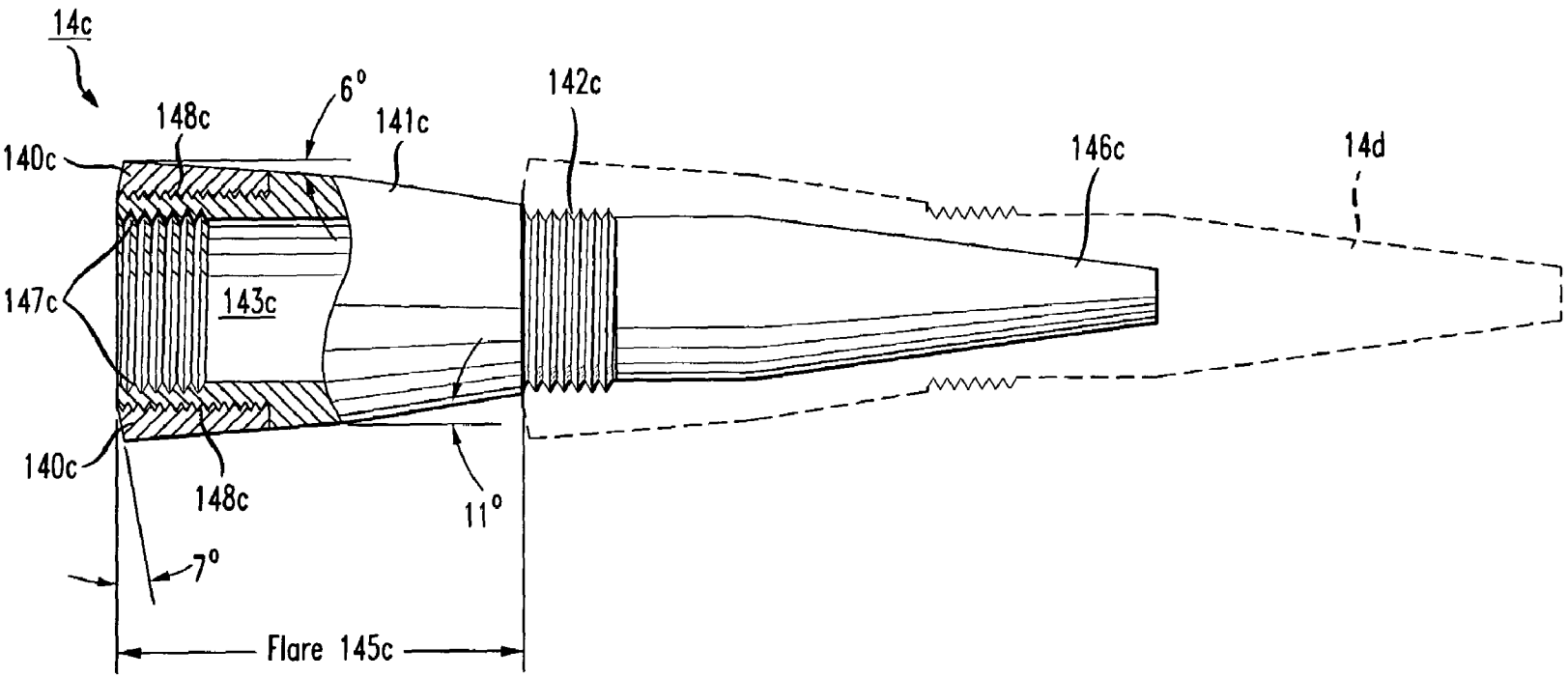
FIG. 4 is a partial cross-sectional view of a typical one of the intermediate segments of the projectile.

Segments 14*a*-14*j* are essentially identical to one another. FIG. 4 shows a partial cross-section of segment 14*c*, taken as illustrative.

Segment 14*c* is threaded onto segment 14*b* (not shown in FIG. 4) by way of interior threads 147*c* on the inner surface of the interior 143*c* of segment 14*c*. Threads 147*c* engage external threads on segment 14*b* that are similar to external threads 142*c* shown in the FIG. for segment 14*c*. Threads 142*c* engage interior threads of segment 14*d* (shown in phantom) that is ahead of segment 14*c* in the assembled projectile. The various threads just mentioned are illustratively shear threads that allow the segments to be pulled apart by whatever separation mechanism is used to provide the necessary segmentation force for the segments. Other techniques to initially hold the segments together but allow them to be pulled apart at segmentation time could be used.

The portion of each one of segments 14*a*-14*j* that is aft of its joint with the preceding segment is flared for stability. The flare angle is chosen so the segment static margin—the distance between mass center and lateral aero force center—is about between 3 to 5 percent of its length, as greater radial motion occurs as the segment becomes less stable. Thus, as shown in FIG. 4, segment 14*c* terminates in a flared portion, or flare, 145*c*. Flare 145*c* has two cone angles of about 11 and 6 degrees, respectively, as seen in FIG. 4. The steeper angle is inside the base flow of the preceding segment, so it will have a negligible drag contribution to the overall projectile.

The mechanism of the radial motion of the segments is explained as follows:

When an aerodynamic body such as the freely flying segment is at a small angle of attack, a radial (or lateral) force is produced normal to the body axis which is proportional to the angle of attack. If the axial position of this force is aft of the mass center, the flight will be "stable", in the sense that a slight increase in the angle of attack will be accompanied by a tendency to pitch the nose down, thereby reducing angle of attack. The degree of stability usually is controlled by selecting the angle of the flare, as increasing the flare angle moves the center of the radial force aft. This force is called "wind fixed", because its direction depends on the direction of the wind relative to the body axis.

The effect of the notch on the flare trailing edge is to introduce a second body fixed force mechanism. The base pressure on the freely flying body is close to ambient, usually slightly lower than ambient. Thus if the notch is deep enough, the pressure in the notch also will be close to ambient. Since the pressure on the side of the flare opposite the notch is high due to the flare angle, a differential force exists between the notch and its image on the opposite side, effectively causing a force increment outward from the notch and acting roughly at its centroid. The lever arm between the notch force and the body mass center is long compared to the lever arm of the radial force due to angle of attack. If the body is not spinning and the moments due to the two forces are in balance, then a "trim" condition will exist, and the body will fly at a "trim angle of attack". Because of the lever ratio, the angle of attack radial force will be much larger than the oppositely directed notch radial force. This unbalance of forces is the cause of the radial acceleration and motion. Reducing the stability margin will increase the lever ratio and thus the magnitude of the radially accelerating force.

Figure 5:
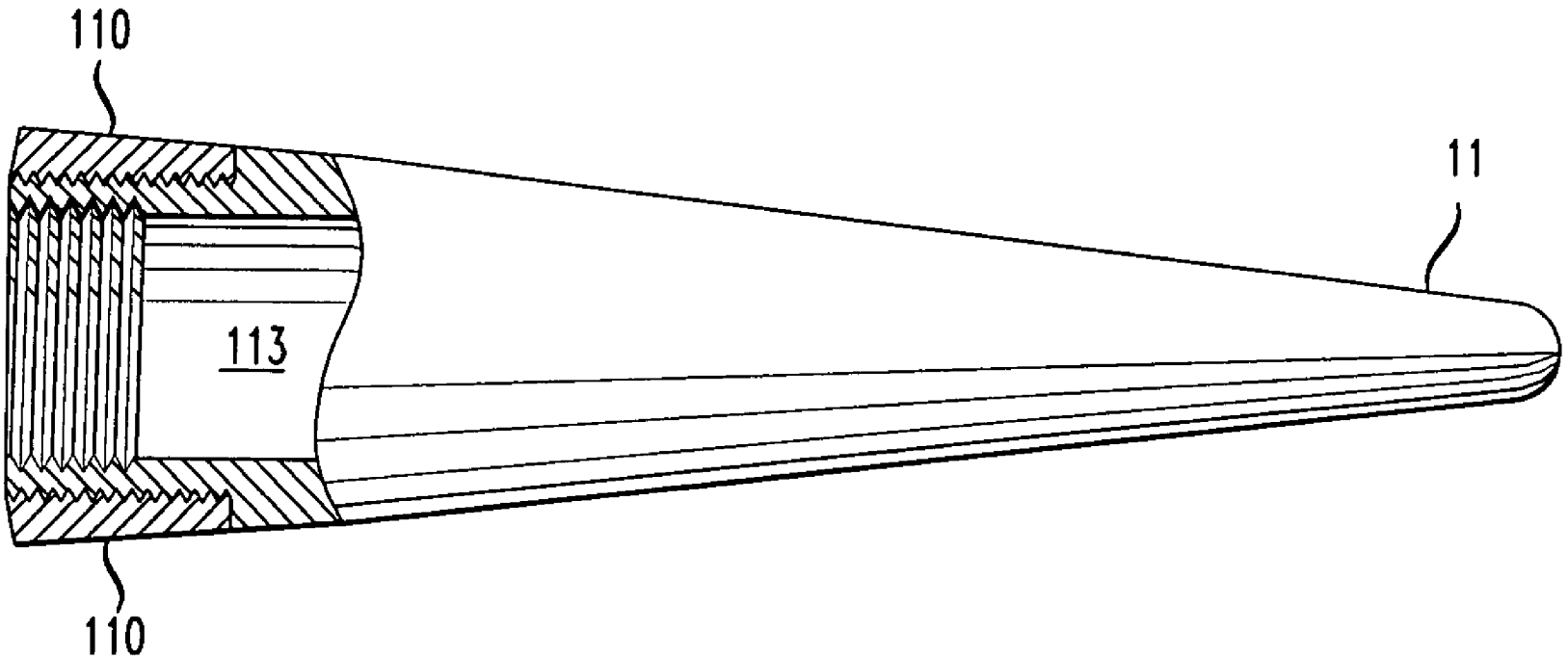
FIG. 5 is a partial cross-sectional view of the lead segment of the projectile.

Returning now to the drawing, lead segment 11 is shown in partial cross-section in FIG. 5. Although not depicted in the drawing, lead segment 11 threads onto segment 14*j* in a similar way to that described above relative to segments 14*a*-14*j*.

Figure 6:
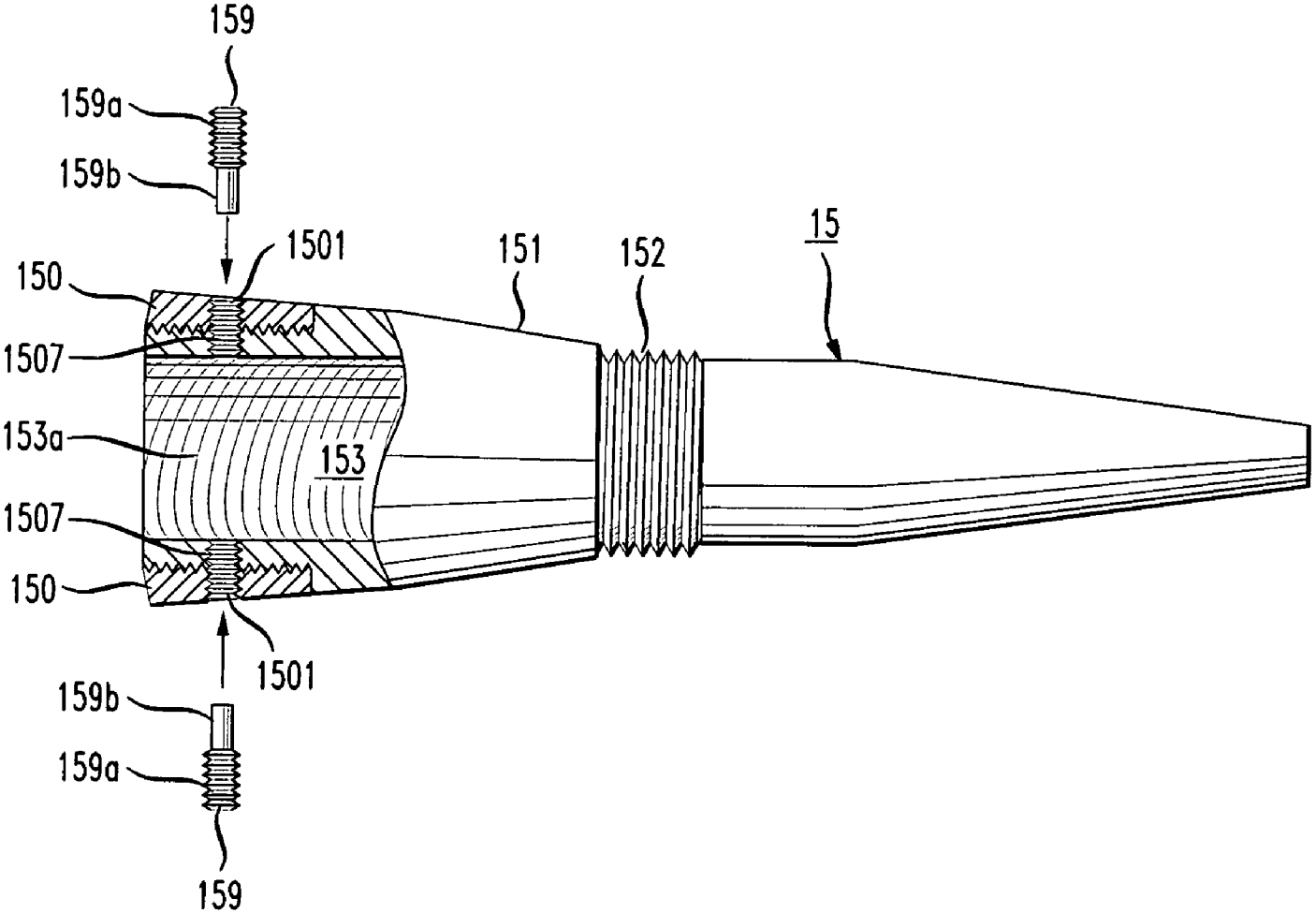
FIG. 6 is a partial cross-sectional view of the second-to-last segment of the projectile.

Second-to-last segment 15 is shown in partial cross-section in FIG. 6. Segment 15 has the same external configuration as segments 14*a*-14*j*.

Each of the segments 11, 14*a*-14*j* and 15 has a notched ring threaded into its aft portion, the notched ring having formed therein notch N shown in FIG. 1. For example, as shown in FIG. 4, a notched ring 140*c* is attached to the aft of segment 14*c*. Flare 145*c* is thus a notched flare. Segments 11 and 15 have similar notched rings, 110 and 150, respectively. In order to achieve a desired mass and balance for segments 14*a*-14*j* and 15, their respective notched rings are made from steel. In order to achieve a desired mass and balance for lead segment 11, its notched ring 110 is made from titanium alloy.

Figure 7:
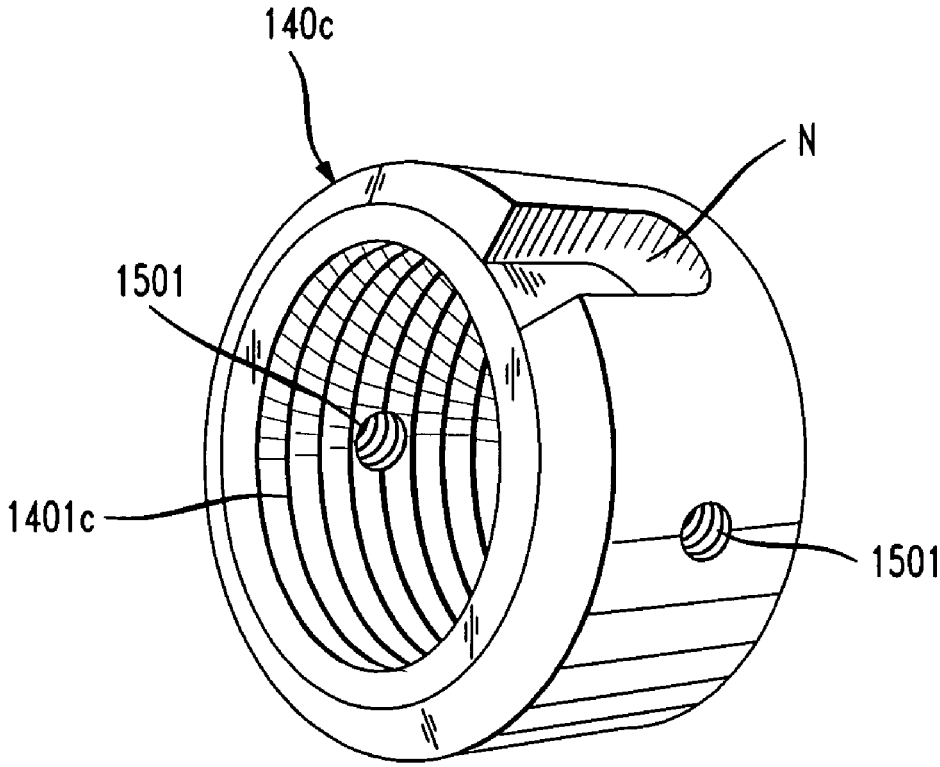
FIG. 7 is a perspective view of a notched ring that is fitted onto the various segments, the notch on a given segment causing it to divert from the projectile's original flight path.

A perspective view of notched ring 140*c*, which is illustrative of the notched rings on each of segments 11, 14*a*-14*j* and 15, is shown in FIG. 7. (Only the notched ring on segment 15, however, has threaded through-holes 1501, which are discussed below.) Notched ring 140*c* has inside threads 1401*c* that mate with threads 148*c* of segment 14*c*. Notched ring 140*c* has formed therein notch N, which causes segment 14*c* to be aerodynamically asymmetric. This causes segment 14*c* to divert from the projectile's original flight path, pursuant to the principles of the invention, once segment 14*c* has detached from the other segments. The azimuthal direction in which the notch on any given segment is pointing at the time it detaches from the remaining portion of the projectile determines the azimuthal the direction in which it will divert after the detaching has occurred. Thus when the overall projectile is being assembled, the notch in each of the notched rings of each of the segments 11, 14*a*-14*j* and 15 is oriented in a respective azimuthal direction relative to the notches on the other rings, causing the various segments to divert in respective directions. Once oriented, the notched ring can be fixed in place in any desired way, such as with a lock nut (not shown) that is then held fast with epoxy. In addition, various ones of the notches are of different sizes. The larger the surface across a notch, the greater will be the radial component of its velocity, i.e., the component of its velocity in the direction away from the original flight path of the projectile. Thus the combination of notch orientation and notch size determines the corresponding segment's position in the dispersion pattern, such as the dispersion pattern of FIG. 3. The design and orientation of the notches in order to achieve a desired dispersion pattern can be arrived at, for example, through straightforward application of aerodynamic principles. Since the segments continue to move away from the original line of flight until impact, the overall diameter the dispersion pattern is not only a function of the velocity of the segments but also the time that the segments fly between segmentation and target impact.

In order for notch N to have the effect just described, the overall projectile should be spinning as little as possible when segmentation begins. Otherwise, the segments will be spinning after detachment, and that spin will tend to overwhelm the aerodynamic effect of the notch and keep each segment on the original flight path of the projectile. This aspect of the design—which is the subject matter of co-pending patent application Ser. No. 11/501,659 entitled "Method And Apparatus For Changing The Spin Of A Projectile In Flight," filed of even date herewith, assigned to the same assignee, and hereby incorporated by reference as though fully set forth herein—is discussed in further detail hereinbelow.

Figure 8:
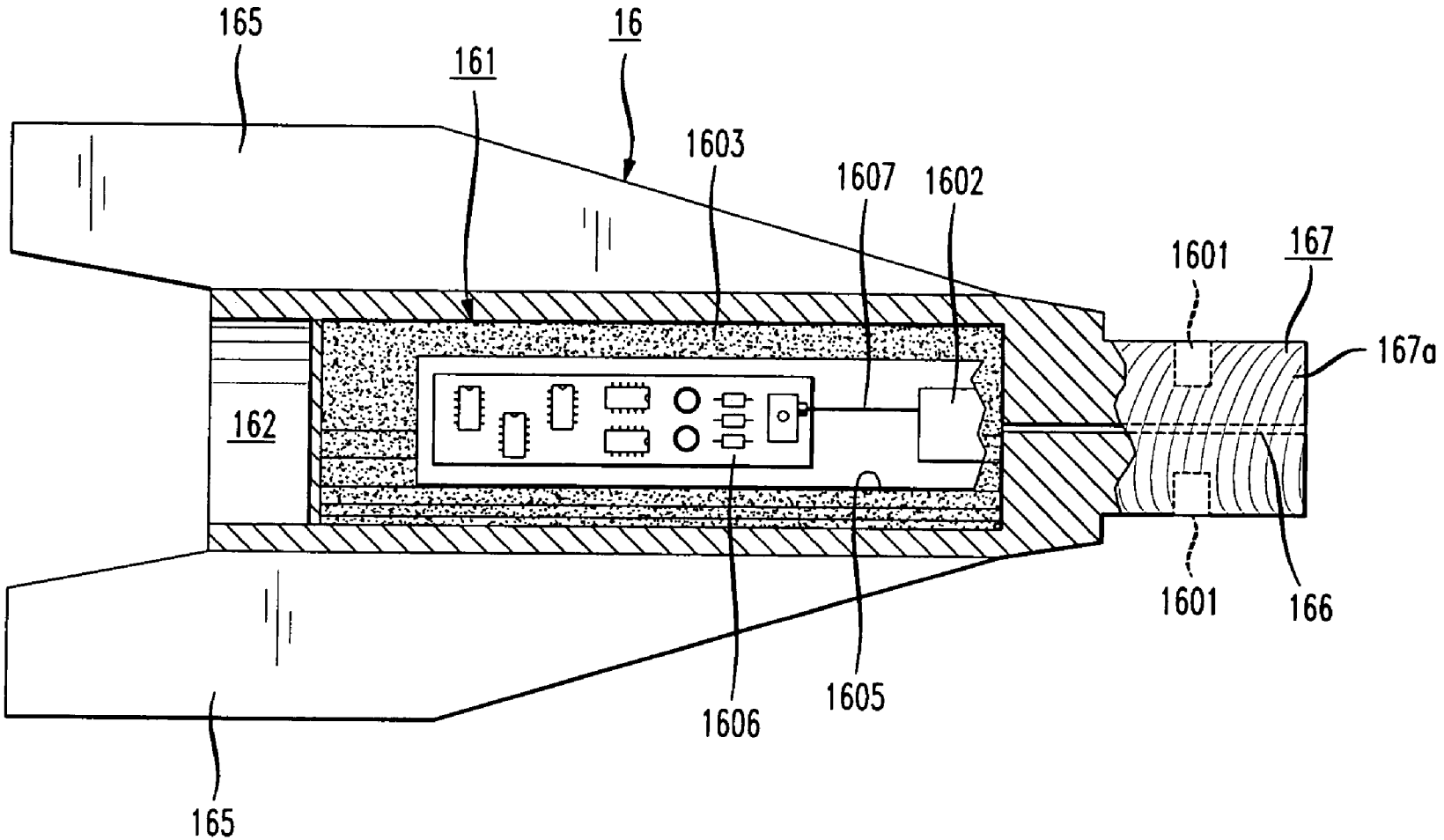
FIG. 8 is a cross-sectional view of the tail segment of the projectile.
Figure 9:
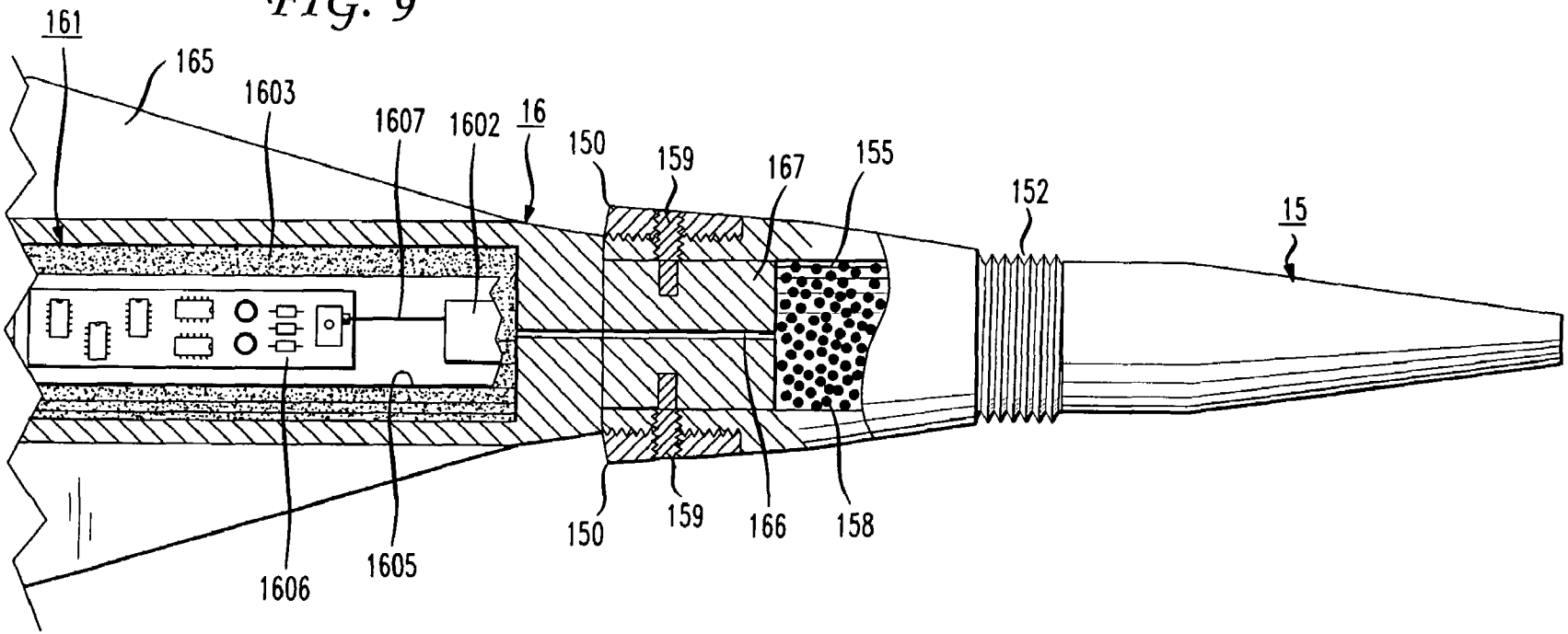
FIG. 9 is a cross-sectional view of the segments of FIGS. 6 and 8 mated as they would be within the overall projectile.

The last, or tail, segment 16 is shown in cross-section in FIG. 8 and is also shown in cross-section in FIG. 9 mated with segment 15. Tail segment 16 is illustratively made from a single piece of titanium alloy, so that its fins 165 are integral with the main body of the segment. Fins 165 may extend past the main segment body in order to assure stability of the overall projectile in a case where the fin span is relatively small, as may be needed to clear the rails of the projectile launcher.

Segment 16 includes fuze cavity 161 which contains a canister 1605 embedded in epoxy 1603. Contained within the canister are electronics 1606, which are also embedded in epoxy (not shown) within the canister in order to stabilize the electronics during flight. Electronics 1606 controls the setting off of an igniter 1602 via a signal on lead 1607 generated at a programmed at an optimally selectable distance based on target type. A gas passage 166 extends through the nose, or rifled piston, 167 of tail segment 16, providing a path for the hot gases formed from the igniter into segment 15. Those hot gases set off propellant 158—illustratively gun power—in segment 15. The pressure of the propellant gases within segment 15 pushes against piston 167 and causes tail segment 16 to detach from the remaining portion of the projectile. A separate tracer cavity 162 contains tracer material that emits a visible trail when the projectile is in flight, allowing personnel responsible for the launching of the projectile to follow its flight path visually.

It was noted earlier that it is desirable that projectile 10 should be spinning as little as possible when segmentation begins. On the other hand, it is desirable for a significant amount of spin to be imparted to the projectile at launch. This will minimize any effects of body fixed asymmetries throughout the projectile's flight prior to segmentation and thereby help keep the projectile on course until segmentation occurs. Indeed, fins 165 on tail segment 16 are canted about ½ degree relative to the projectile axis, so the projectile will spin up to an asymptotic rate on the order of tens of Hz after launch.

In accordance with a feature of the invention, the spin is arrested prior to segmentation. The segments then come apart axially in a non-spinning or close-to-non-spinning condition.

Arresting of the spin is achieved by the design of second-to-last segment 15 and tail segment 16. In particular, FIG. 9 shows segments 15 and 16 in their mated configuration. As seen from FIGS. 6 and 8, the outer surface 167*a* of piston 167 and the surface 153*a* of chamber 153 that mates with piston 167 are rifled. Segments 15 and 16 are held together with shear pins 159 having a threaded section 159*a* which threads through threaded through-hole 1501 in the notched ring and into threaded through-hole 1507 in the body 151 of segment 15. A non-threaded portion 159*b* of each shear pin extends into a non-threaded hole 1601 in piston 167. For drawing simplicity, the FIGS. depict the use of two shear pins. In practice, however, three or four shear pins may be more desirable. This arrangement fixes the azimuth of notch N in notched ring 150, that azimuth thus serving as an azimuthal reference for all of the other notches in the projectile.

As previously noted, ignition of the igniter in cavity 161 propagates hot gases into mating chamber 153 of second-to-last segment 15. The pressure build-up in chamber 153 caused by gases formed when propellant 158 is set off causes pins 159 to shear, thereby separating tail segment 16 from segment 15 and thus from the rest of the projectile. The aforementioned rifling causes the spin rate of tail segment 16 to increase as it separates from segment 15. The other inter-segment joints of the projectile are sufficiently tight that the increase in the spin rate of tail segment 16 causes a decrease in the spin rate of the remainder of the projectile, per the law of the conservation of angular momentum. The rifling angle is illustratively 3 degrees—the angle being shown greatly exaggerated in the drawing—which, in this design, will reduce the spin rate of the projectile to approximately zero upon the detachment of tail segment 16. The spin rate of the projectile need not be reduced exactly to zero. Even if a small amount of residual spin—on the order of a few Hz that is something less than 10 Hz—remains, the aerodynamic effect of the notched ring notches will control the flight of the segments, thereby effectuating the desired diversion of the segments. Residual spin will cause rotation of the whole segment pattern, but it will not affect the relative positions of the segments in the pattern.

The projectile is designed in such a way that separation of segments 15, 14*a*, 14*b*, etc. from one another occurs sufficiently after the ignition of the propellant in fuze cavity 161 so as to allow tail segment 16 to separate completely from the rest of the projectile. This is desirable to ensure that the effect of the increased spin of tail segment 16 is fully imparted to the remaining projectile.

At the time of launch, before firing the projectile, the desired size of the pattern on the target—including the option of not deploying the segments, resulting in the impact of the overall projectile itself—is selected by the gunner or the launch platform's fire control system by preselecting the distance from the target that segmentation is to occur. As is conventional, the sabot discards away from the projectile after launch. As is called out in FIG. 4 by way of example, the trailing edge of each notched ring is beveled 7 degrees to allow the sabot to separate without significant disturbance. Thereafter, the propellant in fuze cavity 161 is set off at a predetermined distance from the target, to reduce the overall projectile spin, followed by segmentation. The individual segments then continue on to the target in their desired dispersion pattern.

The foregoing merely illustrates the principles of the invention and numerous variations and alterations are possible. The following are some of those possibilities:

The notches can be of any desired shape and depth except that the depth must be enough to allow the pressure in the notch to be approximately the segment base pressure. Moreover, rather than having only one notch, one or more of the notched rings could have two or more notches. Rather than being provided on a separate notched ring that is threaded or otherwise attached to the segments, one or more notches could be formed in the actual body of a segment. Some aerodynamic feature (e.g., a raised surface) other than notches could be employed that cause the segments to divert. Rather than making the segments aerodynamically asymmetric in order to engender the desired diversion, one or more of them could be provided with some form of mass asymmetry that causes the diversion.

The disclosed mating mechanisms, e.g., threads and pins, are merely illustrative. Other ways of mating the segments may be possible.

The projectile can have any number of segments. In particular, the number of segments can be changed based on the amount of mass per segment deemed desirable given the nature the intended target, and given the available gun muzzle energy. In addition, the dispersion pattern need not be radially symmetric. Appropriate design of the segments and of the diversion-producing mechanism can result in various symmetric or non-symmetric dispersion patterns as may be desired for a given application.

Projectiles embodying the principles of the invention could be designed in such a way that only a portion of the projectile desegments, allowing the remaining forward portion to continue to the target as a rod. The desegmentation could be effectuated on an every-nth-segment basis, so that each independently flying piece of the projectile comprises two or more segments, so that the target is impacted with pieces of greater mass than if all the segments detached from one another. Such various modes of operation could be selected by the gunner just prior to launch, with the projectile having appropriate control mechanisms to effectuate the desired operational mode.

The projectile of the illustrative embodiment is a kinetic energy projectile. The invention could, however, be implemented in a projectile or vehicle in which one or more of the segments carry explosives that detonate upon contact with, or in the proximity of, the target.

All material specifications, timings, dimensions, masses and other quantitative parameters are illustrative only, and can differ from those disclosed herein as may be deemed desirable by the designer.

It will thus be appreciated that although a specific embodiment of the invention is shown and described herein, those skilled in the art will be able to devise numerous arrangements which, although not shown or described herein, embody the principles of the invention and are thus within their spirit and scope.

The invention claimed is:

1. A projectile comprising a plurality of segments interconnected to form a rod, at least two of the segments being adapted to separate from the projectile while the projectile is in atmospheric flight along a trajectory, at least one of the separated segments being a diverting segment, the design of each diverting segment being such as to cause, after the segment has separated from the projectile, an azimuthal diversion of that segment away from the trajectory of the projectile, wherein each diverting segment has an aerodynamic surface that is configured in such a way as to cause that segment's azimuthal diversion, and wherein at least one of the diverting segments includes a main body and a ring threaded onto the aft of that segment, said ring having said configured aerodynamic surface.

2. The projectile of claim 1 wherein said azimuthal diversion is such as to put the separated segments in a predetermined dispersion pattern.

3. The projectile of claim 1 wherein said configured aerodynamic surface includes at least one notch formed on at least one surface of each diverting segment.

4. The projectile of claim 3 wherein, prior to the first and second segments separating from the projectile, the notch on at least a first one of the diverting segments points in a different azimuthal direction from the notch on at least a second one of the diverting segments.

5. The projectile of claim 3 wherein the notch on at least a first one of the diverting segments differs from the notch on at least a second one of the diverting segments in at least one dimension.

6. The projectile of claim 1 wherein said configured aerodynamic surface has an asymmetry that causes said azimuthal diversion.

7. The projectile of claim 1 wherein said configured aerodynamic surface has at least one notch that causes said azimuthal diversion.

8. The projectile of claim 7 wherein the notch on at least a first one of the diverting segments differs from the notch on at least a second one of the diverting segments in at least one dimension.

9. The projectile of claim 8 wherein, prior to the first and second segments separating from the projectile, the notch on at least a first one of the diverting segments points in a different azimuthal direction from the notch on at least a second one of the diverting segments.

10. The projectile of claim 1 wherein said ring has at least one notch that causes said azimuthal diversion.

11. The projectile of claim 1 wherein one or more of the segments is designed in such a way that any spin of the projectile is reduced prior to the separating of at least one of the segments from the projectile.

12. The projectile of claim 1 wherein one of the segments is a tail section that is the first to be separated from the projectile during said flight, and wherein at least said tail section is designed in such a way that its spin is increased during a period of time in which it is being separated from the projectile, whereby any spin of the projectile is reduced.

13. The projectile of claim 12 wherein prior to the separation of the tail segment, the tail segment is interconnected with another one of the segments at a rifled interface that causes said spin increase when the tail segment is being separated from the projectile.

14. The projectile of claim 12 wherein at least one of the segments is designed in such a way that the tail section fully separates from the projectile before any other one of the segments separates from the projectile.

* * * * *